US007202407B2

(12) United States Patent
Kawashima et al.

(10) Patent No.: US 7,202,407 B2
(45) Date of Patent: Apr. 10, 2007

(54) TONE MATERIAL EDITING APPARATUS AND TONE MATERIAL EDITING PROGRAM

(75) Inventors: Susumu Kawashima, Shizuoka-ken (JP); Takashi Kuramochi, Kanagawa-ken (JP); Takuji Kumazawa, Kanagawa-ken (JP); Toru Itayama, Shizuoka-ken (JP)

(73) Assignee: Yamaha Corporation, Shizuoka-Ken (JP)

( * ) Notice: Subject to any disclaimer, the term of this patent is extended or adjusted under 35 U.S.C. 154(b) by 31 days.

(21) Appl. No.: 10/375,655

(22) Filed: Feb. 27, 2003

(65) Prior Publication Data

US 2003/0159565 A1 Aug. 28, 2003

(30) Foreign Application Priority Data

Feb. 28, 2002 (JP) ..... 2002-054121
Feb. 28, 2002 (JP) ..... 2002-054122
Feb. 28, 2002 (JP) ..... 2002-054123
Feb. 28, 2002 (JP) ..... 2002-054124

(51) Int. Cl.
*A63H 5/00* (2006.01)
*G04B 13/00* (2006.01)
*G10H 7/00* (2006.01)

(52) U.S. Cl. ..... 84/609; 84/610; 84/634; 84/649; 84/650; 84/666; 84/477 R

(58) Field of Classification Search ..... 84/600–602, 84/609–610, 634, 649–650, 666, 477 R, 84/DIG. 6; 434/307 R; 348/564
See application file for complete search history.

(56) References Cited

U.S. PATENT DOCUMENTS 5,335,073 A * 8/1994 Yamamoto ..... 434/307 A
5,499,922 A * 3/1996 Umeda et al. ..... 434/307 A
5,810,603 A * 9/1998 Kato et al. ..... 434/307 A
5,854,619 A * 12/1998 Kato ..... 345/23
5,886,275 A * 3/1999 Kato et al. ..... 84/609
6,056,555 A * 5/2000 Tada ..... 434/307 A

FOREIGN PATENT DOCUMENTS

JP 05-28728 2/1993

(Continued)

OTHER PUBLICATIONS

Translation of Decision of Refusal in the basic Japanese Patent Application No. 2002-054123.

(Continued)

*Primary Examiner*—Marlon Fletcher
(74) *Attorney, Agent, or Firm*—Harness, Dickey & Pierce, PLC

(57) ABSTRACT

There are provided tone material editing apparatus and program. The tone material editing apparatus is connected to a tone material providing apparatus that provides tone material data. Video data stored in the tone material editing apparatus is reproduced. The tone material providing apparatus is instructed to stream-distribute tone material data to be reproduced in synchronism with the reproduced video data. The tone material data stream-distributed from the tone material providing apparatus is stream-reproduced in synchronism with the reproduced video data.

14 Claims, 8 Drawing Sheets

FOREIGN PATENT DOCUMENTS

| | | |
|---|---|---|
| JP | 06-250649 | 9/1994 |
| JP | 2001-202082 | 7/2001 |
| JP | 2002-055865 | 2/2002 |

OTHER PUBLICATIONS

Japanese Official Action dated Sep. 6, 2005 (JP 2002-154122).
Japanese Official Action dated Sep. 6, 2005 (JP 2002-054124).
Decision of Refusal, dated Aug. 22, 2006, in corresponding Japanese Patent Application No. 2002-054121 along with English translation.

* cited by examiner

TONE MATERIAL EDITING APPARATUS AND TONE MATERIAL EDITING PROGRAM

BACKGROUND OF THE INVENTION

1. Field of the Invention

The present invention relates to tone material editing apparatus and program that enable candidate tone material data, which would be added to video data, to be audited while reproducing the video data, performs real-time processing on the tone material data to be added to the video data so that the tone material data can be audited, processes the tone material data in the MIDI file format and converts the processed tone material data into data in a predetermined audio format, and acquires tone material data to be added to video data from a tone material providing site that provides tone material data.

2. Description of the Related Art

Conventionally, there is known a service that provides tone material data (e.g. musical composition data in the MIDI (Musical Instrument Digital Interface) format) via a server computer functioning as a web site so that the user can download the tone material data by accessing the web site via a personal computer or the like.

There is also conventionally known a video editing apparatus that is capable of adding tone material data as background music (hereinafter referred to as "BGM") to video data.

This conventional video editing apparatus, however, has the problem that, when tone material data is added as BGM to video data, the tone material data and the video data cannot be reproduced at the same time unless an editing operation is completed in which tone material data downloaded in advance is added to video data. Therefore, the user cannot ascertain how tone material data (e.g. BGM) has been added to video data until after the editing operation is completed.

Further, the conventional video editing apparatus has the problem of editing video data with a low working efficiency and lacking the usability because, in order to acquire desired BGM, there is the necessity of downloading a large number of tone material data in advance or accessing a web site many times and downloading tone material data in each access for the reason that tone color data must be downloaded in advance before the editing operation is carried out.

There is also conventionally known a tone material processing apparatus that is capable of processing tone material data, such as a MIDI sequencer that is capable of processing MIDI (Musical Instrument Digital Interface) data.

If the user desires to add tone material data as BGM to video data, he or she cannot ascertain the video data with the tone material data (BGM) added thereto until after an editing operation is completed by a video editing apparatus after the tone material data is processed and stored in a file by the tone material processing apparatus. Therefore, the working efficiency is very low in the case where tone material data is repeatedly processed many times.

Further, a data converting apparatus that converts tone material data downloaded from a web site into data in a predetermined audio format, and a video editing apparatus that is capable of adding tone material data in an audio format as BGM to video data are conventionally known.

If the user adds tone material data in the MIDI file format as BGM to video data, and in particular, if the user does not like the tone color data as it is, he or she has to use the MIDI sequencer or the like so as to process the tone material data as desired (for example, change the part structure, tone color, volume, effect, tempo, or pitch), store the processed tone material data once in an arbitrary file, convert the tone material data stored in the arbitrary file into data in a predetermined audio format by the data converting apparatus, and add the converted data in the audio format to the video data by the video editing apparatus. This is very troublesome because the user has to perform processing using many apparatuses. Further, although the MIDI sequencer has an advantage of generally having many functions and being capable of freely performing various processing on tone material data in the MIDI file format, it has a disadvantage of it being difficult for beginners to fully utilize.

Further, when the user accesses a web site via a personal computer or the like in order to download tone material data, he or she designates a reproduction time in which tone material data is reproduced, and the like on the web site, and a server computer functioning as the web site retrieves tone material data conforming to information on the designated reproduction time and transmits the retrieved tone material data to the user's personal computer or the like.

Therefore, to make the reproduction time of video data and the reproduction time of tone material data correspond to each other, the user has to recognize the reproduction time of the video data in advance. For this reason as well, video data is edited with a low working efficiency.

SUMMARY OF THE INVENTION

It is therefore a first object of the present invention to provide tone material editing apparatus and program that enable achievement of improved working efficiency in video editing.

It is a second object of the present invention to provide tone material editing apparatus and program that enable achievement of improved working efficiency in the format conversion of tone material data.

To attain the above object, in a first aspect of the present invention, there is provided a tone material editing apparatus connected to a tone material providing apparatus that provides tone material data, comprising a video reproducing section that reproduces video data, a stream-distribution instructing section that instructs the tone material providing apparatus to stream-distribute tone material data to be reproduced in synchronism with the video data reproduced by the video reproducing section, and a stream-reproducing section that stream-reproduces the tone material data stream-distributed from the tone material providing apparatus in synchronism with the video data reproduced by the video reproducing section.

With the above arrangement according to the first aspect of the present invention, the tone material data stream-distributed from the tone material providing apparatus is stream-reproduced in synchronism with the video data being reproduced. As a result, before downloading tone material data to be added to video data, the stream reproduction enables the user to ascertain how the tone material data (e.g. BGM) will be added to the video data, and therefore it is possible to improve the working efficiency in video editing.

Preferably, in the tone material editing apparatus according to the first aspect, wherein the stream-reproducing section comprises a determining section that determines whether it is possible to stream-reproduce the tone material data stream-distributed from the tone material providing apparatus, and a video data reproduction start instructing section responsive to a determination by the determining section that it is possible to stream-reproduce the tone material data, for instructing the video reproducing section to start reproducing the video data, wherein the stream-reproducing section is responsive to the video data reproduction start instructing section instructing the video reproducing section to start reproducing the video data, for starting stream-reproducing the tone material data stream-distributed from the tone material providing apparatus.

With this arrangement, since the stream-reproducing section is responsive to the video data reproduction start instructing section instructing the video reproducing section to start reproducing the video data, for starting stream-reproducing the tone material data stream-distributed from the tone material providing apparatus, the tone material data and the video data can be reproduced in synchronism with each other without fail.

Preferably, in the tone material editing apparatus according to the first aspect, the stream-reproducing section comprises a reproduction stop detecting section that detects a stop of reproduction of the video data by the video reproducing section, and a stream-distribution stop instruction transmitting section responsive to the stop of the reproduction of the video data, for transmitting an instruction for stopping the stream distribution of the tone material data to the tone material providing apparatus.

With this arrangement, since a stop of the reproduction of the video data is detected and an instruction for stopping stream-distribution of the tone material data is transmitted to the tone material providing apparatus, the user does not have to give an instruction for stopping the stream distribution each time.

To attain the first object, in a second aspect of the present invention, there is provided a tone material editing apparatus connected to a tone material providing apparatus that provides tone material data, comprising a stream-distribution instructing section that instructs the tone material providing apparatus to stream-distribute the tone material data, a determining section that determines whether it is possible to stream-reproduce the tone material data stream-distributed from the tone material providing apparatus, a video data reproduction start instructing section responsive to a determination by the determining section that it is possible to stream-reproduce the tone material data, for instructing a video reproducing means to start reproducing the video data, and a stream-reproducing section responsive to the video data reproduction start instructing section instructing the video reproducing means to start reproducing the video data, for starting stream-reproducing the tone material data stream-distributed from the tone material providing apparatus.

With the above arrangement according to the second aspect of the present invention, the stream-reproducing section is responsive to the video data reproduction start instructing section instructing the video reproducing means to start reproducing the video data, for starting stream-reproducing the tone material data stream-distributed from the tone material providing apparatus. As a result, the tone material data and the video data can be reproduced in synchronism with each other without fail.

To attain the first object, in a third aspect of the present invention, there is provided a tone material editing apparatus connected to a tone material providing apparatus that provides tone material data, comprising a stream-reproducing section that stream-reproduces the tone material data stream-distributed from the tone material providing apparatus, a reproduction stop detecting section that detects a stop of reproduction of video data reproduced by a video reproducing means, and a stream-distribution stop instruction transmitting section responsive to the stop of reproduction of the video data, for transmitting an instruction for stopping stream-distributing the tone material data to the tone material providing apparatus.

With the above arrangement according to the third aspect of the present invention, the stream-distribution stop instruction transmitting section is responsive to the stop of reproduction of the video data, for transmitting an instruction for stopping stream-distributing the tone material data to the tone material providing apparatus.

With the above arrangement according to the third aspect of the present invention, the user does not have to give an instruction for stopping the stream distribution each time.

To attain the first object, in a fourth aspect of the present invention, there is provided a tone material editing apparatus comprising a video editing section that reproduces video data and edits the video data by adding tone material data thereto, a tone material data processing section operable when the video editing section is reproducing the video data, for processing the tone material data to be added to the video data in synchronism with the reproduction of the video data, and a tone material data reproducing section that reproduces tone material data having been processed or having not been processed by the tone material data processing section in synchronism with the reproduction of the video data.

With the above arrangement according to the fourth aspect of the present invention, when video data is being reproduced, tone material data to be added to the video data is processed and reproduced in synchronism with the reproduction of the video data. As a result, the user can ascertain how tone material data (e.g. BGM) will be added to video data, and it is possible to improve the working efficiency in video editing.

Preferably, in the tone material editing apparatus according to the fourth aspect, the processing of the tone material data comprises controlling parameters included in the tone material data.

Preferably, in the tone material editing apparatus according to the fourth aspect, the parameters included in the tone material data comprise parameters for controlling at least one of turning-on/off of parts, tone color change, processing using a mixer, application of effects, tempo change, and pitch change.

Preferably, in the tone material editing apparatus according to the fourth aspect, wherein the tone material data processing section further processes tone material data to be added to video data before the video editing section reproduces the video data.

As a result, tone material data to be added to video data can be processed in advance before the video data is reproduced, and it is possible to improve the working efficiency in video editing.

To attain the first object, in a fifth aspect of the present invention, there is provided a tone material editing apparatus comprising a tone material data reproducing section responsive to an instruction for reproducing video data, transmitted from a video editing means that reproduces video data and edits the video data by adding tone material data thereto, for reproducing the tone material data, and a tone material data processing section that processes the tone material data when the tone material data is being reproduced.

With the above arrangement according to the fifth aspect of the present invention, tone material data is reproduced in response to an instruction for reproducing video data transmitted from the video editing means, and the tone material data is processed when being reproduced. As a result, it is possible to reproduce and process tone material data in synchronism with the reproduction of video data, and to improve the working efficiency in video editing.

Preferably, in the tone material editing apparatus according to the fifth aspect, the processing of the tone material data comprises controlling parameters included in the tone material data.

Preferably, in the tone material editing apparatus according to the fifth aspect, the parameters included in the tone material data comprise parameters for controlling at least one of turning-on/off of parts, tone color change, processing using a mixer, application of effects, tempo change, and pitch change.

To attain the second object, in a sixth aspect of the present invention, there is provided a tone material editing apparatus comprising a tone material data processing section that performs processing on tone material data in a MIDI format, and a converting section that converts the tone material data processed by the tone material data processing section into data in a predetermined audio format.

With the above arrangement according to the sixth aspect of the present invention, tone material data in the MIDI file format is processed in a manner, and the processed tone material data is converted into data in a predetermined audio format. As a result, it is possible to carry out a sequence of operations from processing on the tone material data up to conversion of the format of the tone material data into an audio format all at once, and to improve the working efficiency in the format conversion of the tone material data.

Preferably, in the tone material editing apparatus according to the sixth aspect, the processing of the tone material data comprises controlling parameters included in the tone material data.

Preferably, in the tone material editing apparatus according to the sixth aspect, the parameters included in the tone material data comprise parameters for controlling at least one of turning-on/off of parts, tone color change, processing using a mixer, application of effects, tempo change, and pitch change.

Preferably, in the tone material editing apparatus according to the sixth aspect, the tone material data processing section operates in cooperation with a video data reproducing unit that contains video data and reproduces the video data, and the tone material data has been processed by the tone material data processing section in synchronism with reproduction of the video data.

Since the tone material data processed by the tone material data processing section is converted into the audio format in synchronism with reproduction of the video data, the tone material data to be added to the video data can be processed efficiently.

To attain the first object, in a seventh aspect of the present invention, there is provided a tone material editing apparatus connected to a tone material providing apparatus that provides tone material data, comprising a characteristic data acquiring section that acquires the characteristic data from a video editing means that contains video data and characteristic data relating to the video data and edits the video data, a characteristic data supplying section that supplies the characteristic data acquired by the characteristic data acquiring section to the tone material providing apparatus, and a tone material data acquiring section that acquires tone material data extracted by the tone material providing apparatus according to the characteristic data supplied thereto, from the tone material providing apparatus.

With the above arrangement according to the seventh aspect of the present invention, the characteristic data is acquired from the video editing means and is supplied to the tone material providing apparatus, and the tone material data extracted by the tone material providing apparatus is acquired from the tone material providing apparatus according to the characteristic data supplied to the tone material providing apparatus. Since the characteristic data is automatically acquired, the user does not have to recognize the reproduction time of the video data, and the tone material data to be added to the video data can be acquired from the tone material providing apparatus in an efficient manner. As a result, it is possible to improve the working efficiency in video editing.

Preferably, in the tone material editing apparatus according to the seventh aspect, wherein the characteristic data includes at least one of data relating to a reproduction time and data relating to title of the video data.

Since at least one of data relating to the reproduction time and title of video data is automatically acquired, it is possible to acquire tone material data desired by the user from the tone material providing site in an efficient manner. As a result, it is possible to improve the working efficiency in video editing.

To attain the first object, in an eighth aspect of the present invention, there is provided a tone material editing program executed by a computer connected to a tone material providing apparatus that provides tone material data, comprising a video reproducing module for reproducing video data, a stream-distribution instructing module for instructing the tone material providing apparatus to stream-distribute tone material data to be reproduced in synchronism with the video data reproduced by the video reproducing module, and a stream-reproducing module for stream-reproducing the tone material data stream-distributed from the tone material providing apparatus, and stream-reproducing the tone material data in synchronism with the video data reproduced by the video reproducing module.

To attain the first object, in a ninth aspect of the present invention, there is provided a tone material editing program executed by a computer connected to a tone material providing apparatus that provides tone material data, comprising a stream-distribution instructing module for instructing the tone material providing apparatus to stream-distribute the tone material data, a determining module for determining whether it is possible to stream-reproduce the tone material data stream-distributed from the tone material providing apparatus, a video data reproduction start instructing module responsive to a determination by the determining module that it is possible to stream-reproduce the tone material data, for instructing a video reproducing module to start reproducing video data, and a stream-reproducing module responsive to the video data reproduction start instructing module instructing the video reproducing module to start reproducing the video data, for starting stream-reproducing the tone material data stream-distributed from the tone material providing apparatus.

To attain the first object, in a tenth aspect of the present invention, there is provided a tone material editing program executed by a computer connected to a tone material providing apparatus that provides tone material data, comprising a stream-reproducing module for stream-reproducing the tone material data stream-distributed from the tone material providing apparatus, a reproduction stop detecting module for detecting a stop of reproduction of video data reproduced by a video reproducing module, and a stream-distribution stop instruction transmitting module responsive to the stop of reproduction of the video data, for transmitting an instruction for stopping stream-distributing the tone material data to the tone material providing apparatus.

To attain the first object, in an eleventh aspect of the present invention, there is provided a tone material editing module executed by a computer storing tone material data and video data, comprising a video editing module for reproducing video data and editing the video data by adding tone material data thereto, a tone material data processing module operable when the video data is being reproduced by the video editing module, for processing the tone material data to be added to the video data in synchronism with the reproduction of the video data, and a tone material data reproducing module for reproducing tone material data having been processed or having not yet been processed by the tone material data processing module in synchronism with the reproduction of the video data.

To attain the first object, in a twelfth aspect of the present invention, there is provided a tone material editing program executed by a computer, comprising a tone material data reproducing module responsive to an instruction for reproducing the video data transmitted by a video editing module for reproducing video data and editing the video data by adding tone material data thereto, for reproducing the tone material data, and a tone material data processing module for processing the tone material data when the tone material data is being reproduced.

To attain the second object, in a thirteenth aspect of the present invention, there is provided a tone material editing program executed by a computer storing tone material data in a MIDI format, comprising a tone material data processing module for performing processing on tone material data in a MIDI format, and a converting module for converting the tone material data processed by the tone material data processing module into data in a predetermined audio format.

To attain the first object, in a fourteenth aspect of the present invention, there is provided a tone material editing program connected to a tone material providing apparatus, comprising a characteristic data acquiring module for acquiring the characteristic data from video editing means containing video data and characteristic data relating to the video data, a characteristic data supplying module for supplying the characteristic data acquired by the characteristic data acquiring module to the tone material providing apparatus, and a tone material data acquiring module for acquiring tone material data extracted by the tone material providing apparatus according to the characteristic data supplied to the tone material providing apparatus, from the tone material providing apparatus.

The above and other objects, features, and advantages of the invention will become more apparent from the following detailed description taken in conjunction with the accompanying drawings.

DETAILED DESCRIPTION OF THE PREFERRED EMBODIMENT

The present invention will now be described in detail with reference to the drawings showing a preferred embodiment thereof.

Figure 1:
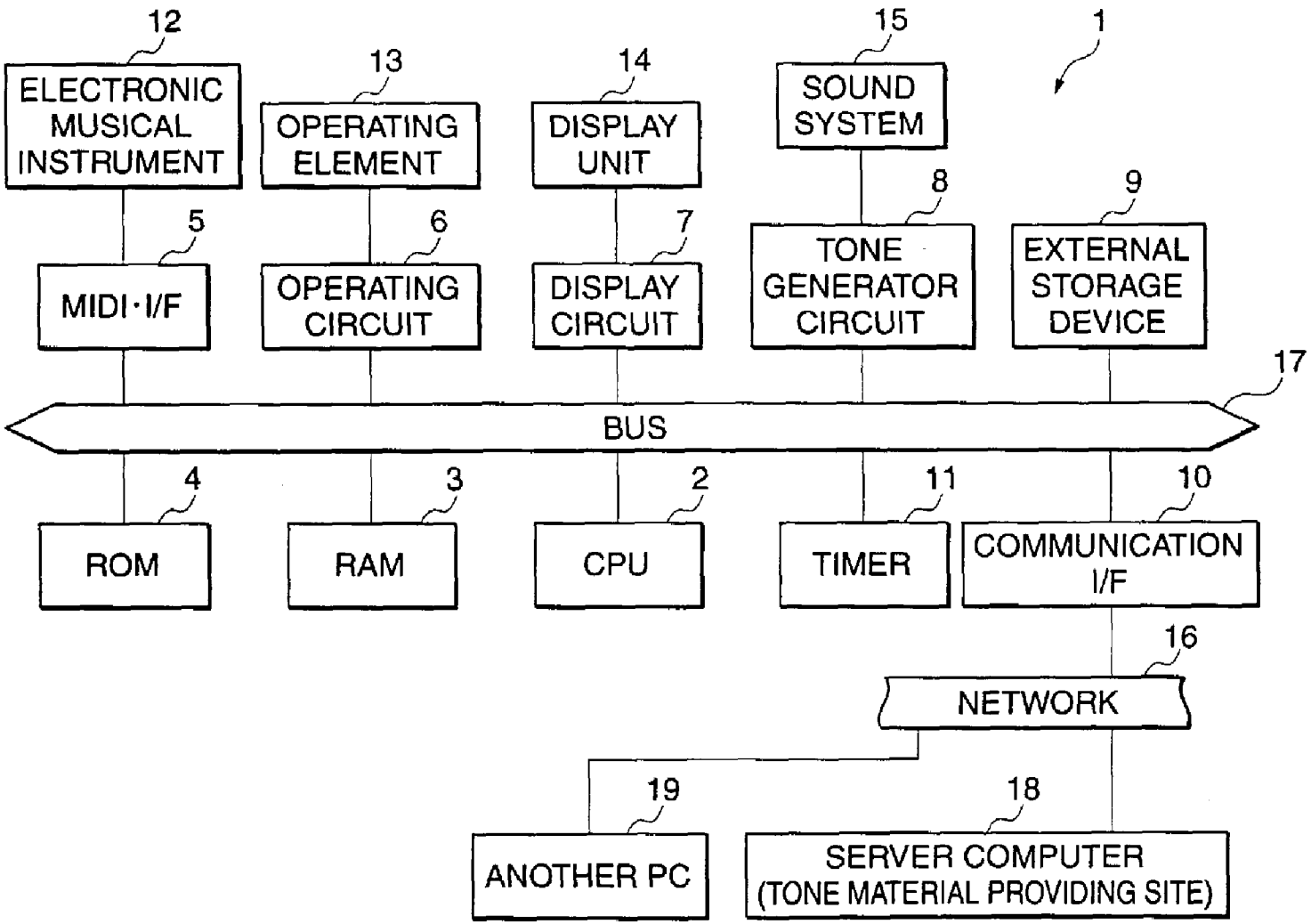
FIG. 1 is a block diagram schematically showing the hardware construction of a tone material editing apparatus according to an embodiment of the present invention.

FIG. 1 is a block diagram schematically showing the hardware construction of a tone material editing apparatus according to an embodiment of the present invention.

In the present embodiment, the tone material editing apparatus is applied to a personal computer (PC) 1, for example.

The PC 1 includes a CPU 2 that controls the overall operations of the PC 1, and a RAM 3, a ROM 4, a MIDI interface (I/F) 5, an operating circuit 6, a display circuit 7, a tone generator circuit 8, an external storage device 9, a communication interface (I/F) 10, and a timer 11 are connected to the CPU 2 via a communication bus 17.

The RAM 3 temporarily stores a variety of information relating to video data and tone material data and a variety of data generated when the CPU 2 executes a variety of programs. The ROM 4 stores a variety of programs and a variety of data (e.g. video data, video time data and title data as characteristic data of the video data, a video editing program, tone material editing programs such as a tone material processing/reproducing program and a data format converting program) executed or referred to by the CPU 2. The MIDI interface (I/F) 5 is for connecting an electronic musical instrument 12 to the communication bus 17, and provides interface for exchanging MIDI data between the electronic musical instrument 12 and the PC 1. The operating circuit 6 connects an operating element 13 to the communication bus 17, and outputs input data from the operating element 13 such as a mouse, a keyboard, or the like to the CPU 2 via the communication bus 17. The display circuit 7 connects a display unit 14 to the communication bus 17, and outputs a variety of data such as video data and tone material data comprised of MIDI data or image data corresponding to a player, which reproduces the video data and the tone material data, to the display unit 14. The display unit 14 displays the variety of data outputted from the display circuit 7. The tone generator circuit 8 receives tone material data via the communication bus 17, and outputs a musical tone signal based on the tone material data to a sound system 15. The sound system 15 generates the inputted musical tone signal. The timer 11 is used for various processing performed by the CPU 2.

The external storage device 9 stores a variety of data such as video data and tone material data as samples and a variety of programs to be executed or referred to by the CPU 2, and realizes the same functions as the ROM 4. The CPU 2 causes the RAM 3 to read the variety of data and the variety of programs stored in the external storage device 9 to perform processing, so that the same operation can be performed as in the case where the ROM 4 stores the variety of data and the variety of programs. Therefore, by replacing the external storage device 9, a variety of programs can be added and the version of the programs can be upgraded in an easy way.

The communication I/F 10 is radio-connected or is connected by wire to a network 16 such as the Internet or a commercial network, and the PC 1 is connected to a server computer 18 functioning as a tone material data providing site and another PC 19 via the network 16. Therefore, it is possible to download tone material data from the server computer 18 and to download a variety of data and programs from the PC 19.

The MIDI I/F 5 should not necessarily be a dedicated MIDI I/F, but may be a general-purpose I/F such as the RS232-C, USB, or IEEE 1394. If such a general-purpose I/F is used, data other than MIDI data may be transmitted at the same time that MIDI data is transmitted.

The hardware construction of the server computer 18, which supplies tone material data to the PC 1, is identical with that of the PC 1. The server computer 18, however, is intended mainly to provide such as tone material data to each user terminal such as the PC 1, and thus, the server computer 18 should not necessarily be provided with the MIDI I/F 5, tone generator circuit 8, electronic musical instrument 12, or sound system 15.

Figure 2:
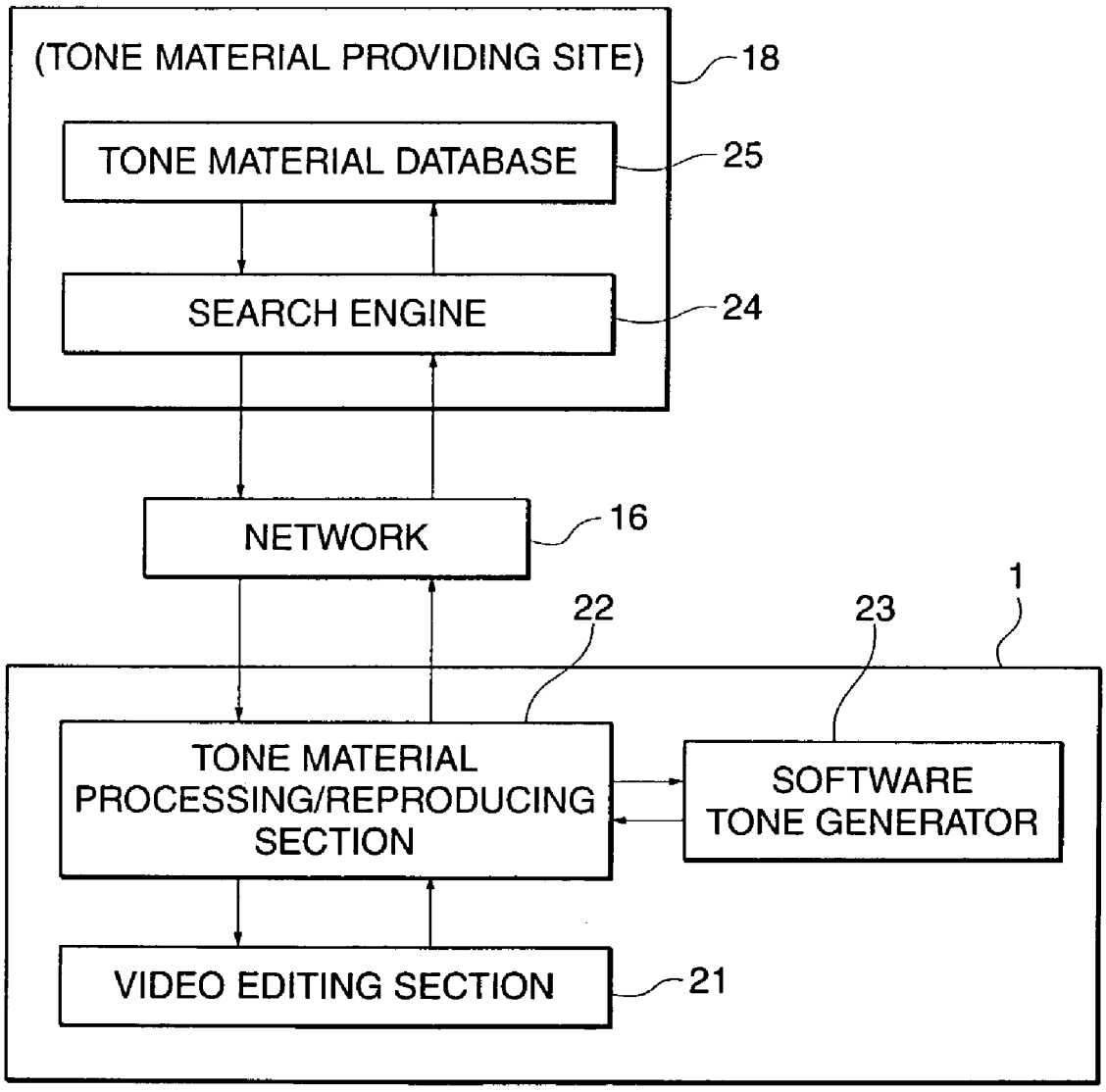
FIG. 2 is a block diagram showing the functional arrangement of a PC 1 and a server computer 18 in FIG. 1.

FIG. 2 is a block diagram showing the functional arrangement of the PC 1 and the server computer 18 in FIG. 1.

The PC 1 is comprised of a video editing section 21 that edits and reproduces video data, a tone material processing/reproducing section 22 that processes and reproduces tone material data, and a software tone generator 23 that converts the data format of tone material data, and the server computer 18 is comprised of a tone material database 25 containing a large number of tone material data, and a search engine 24 that searches the tone material database 25 according to an instruction transmitted from the PC 1 to retrieve tone material data desired by the user.

The functions of the video editing section 21, tone material processing/reproducing section 22, and software tone generator 23 are realized by executing a variety of programs stored in the PC 1 by hardware constituting the PC 1, and the tone material database 25 is a collection of tone material data, and is systematically structured (e.g. according to music categories) so that the tone material data can be searched by the search engine 24. The function of the search engine 24 is realized by executing a tone material data search program stored in the server computer 18 by hardware constituting the server computer 18.

Specifically, the functions of the video editing section 21 are realized by causing the CPU 2 to read the video editing program stored in the ROM 4 or in the external storage device 9 into the RAM 3 and to edit video data stored in the ROM 4 or in the external storage device 9 according to instructions of the video editing program read into the RAM 3, and causing the display unit 14 to display the video data having been received via the display circuit 7 and having not yet been edited or having been edited.

Specifically, the functions of the tone material processing/reproducing section 22 are realized by causing the CPU 2 to read the tone material data processing/reproducing program stored in the ROM 4 or in the external storage into the RAM 3 and to process or reproduce tone material data received from the tone material database 25 according to instructions of the tone material data processing/reproducing program read into the RAM 3, causing the display circuit 14 to visually display the tone material data having been received via the display circuit 7 and having not yet been processed or having been processed, and causing the sound system 15 to sound the tone material data having been received via the tone generator circuit 8 and having not yet been processed or having been processed.

Specifically, the functions of the software tone generator 23 are realized by causing the CPU 2 to read the musical tone waveform converting program stored in the ROM 4 or in the external storage 9 into the RAM 3 and to generate a musical tone waveform on the basis of tone material data received from the tone material database 25 according to instructions of the musical tone waveform converting program read into the RAM 3 and convert the data format.

Specifically, the functions of the search engine 24 are realized by causing the CPU 2 to receive the search conditions from the PC via the communication I/F 10, read the search program stored in the ROM 4 or in the external storage device 9 into the RAM 3, incorporate the received search conditions into the search program to perform searching to retrieve tone material data conforming to the search conditions, and transmit the received tone material data to the PC 1 via the communication I/F 10.

A description will now be given of the functions of a system comprised of the PC 1 and the server computer 18, which are constructed as described above.

Figure 3A:
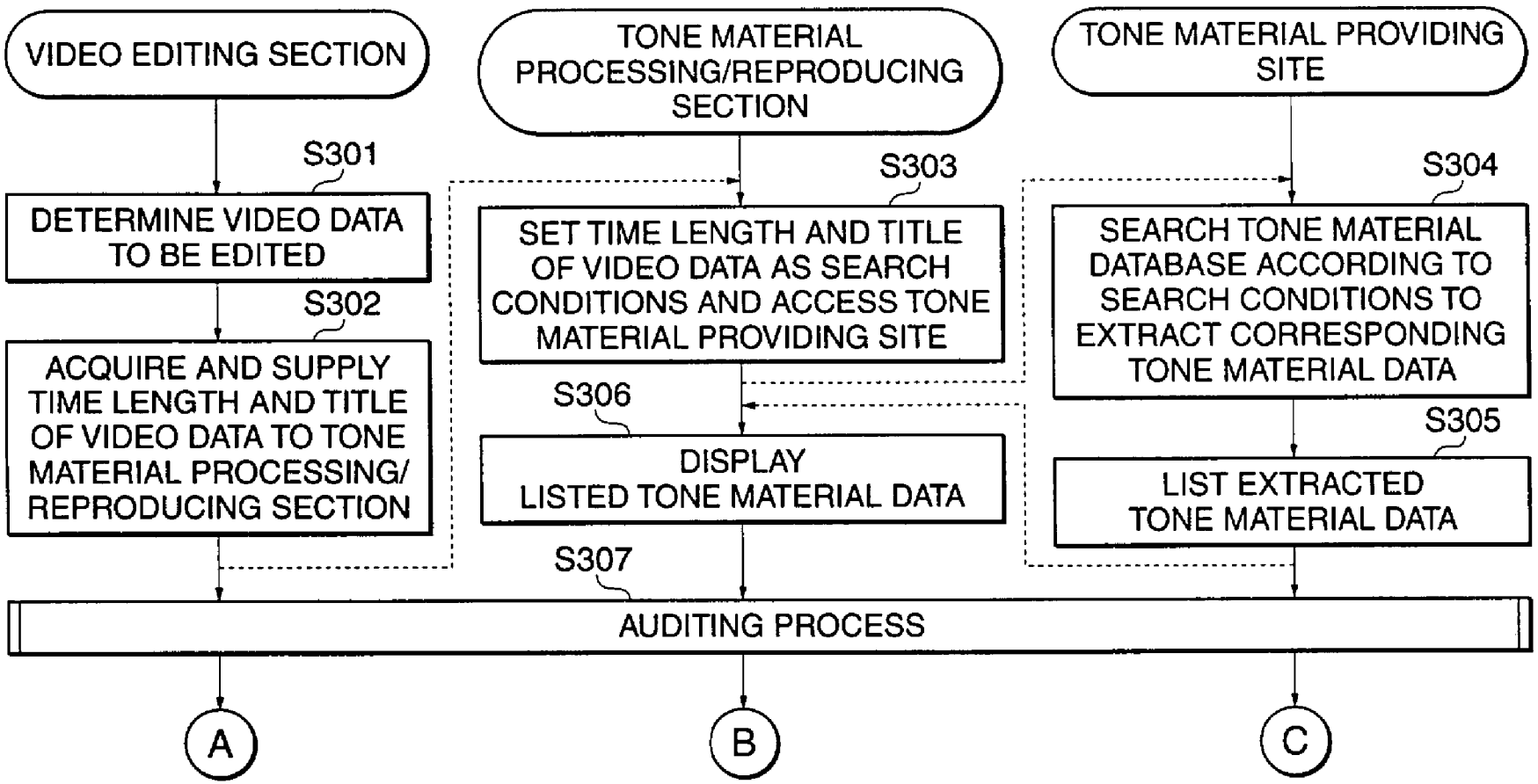
FIGS. 3A and 3B is a flow chart showing a main process carried out by a video editing section 21 and a tone material processing/reproducing section 22 of the PC 1 and the server computer 18 functioning as a tone material providing site in FIG. 1.
Figure 3B:
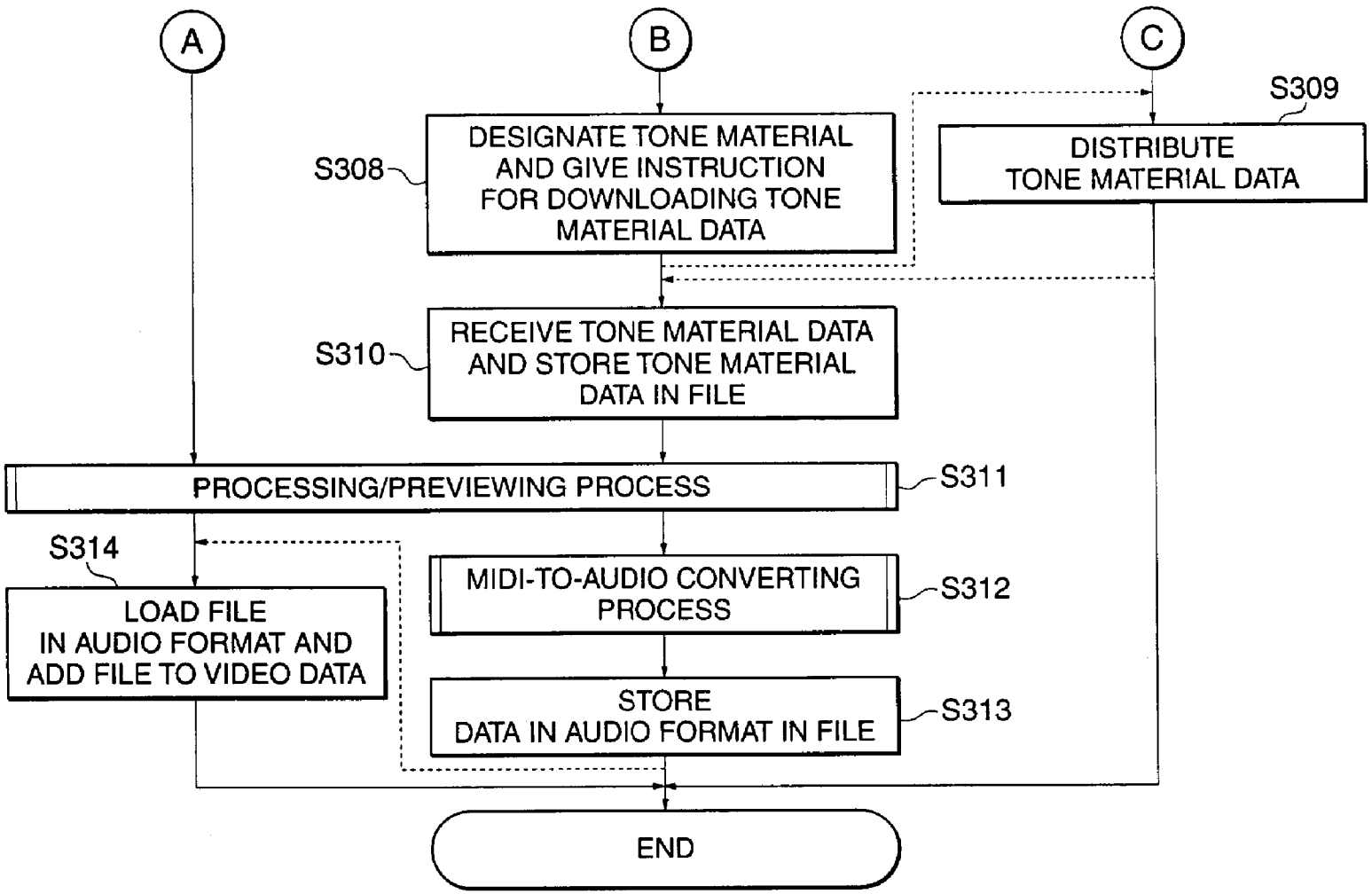

FIGS. 3A and 3B is a flow chart showing a main process carried out by the video editing section 21 and the tone material processing/reproducing section 22 of the PC 1, and the server computer 18 functioning as the tone material providing site. The tone material providing site carries out the main process mainly by the search engine 24.

First, when the user has selected video data, to which tone material data is to be added, by operating the operating element 13, the video editing section 21 determines the video data to be edited (step S301), acquires video time data and title data as characteristic data of the video data, supplies the characteristic data to the tone material processing/reproducing section 22 (step S302), and carries out an auditing process (step S307).

On the other hand, in response to the supply of the video time data and title data as the characteristic data from the video editing section 21, the tone material processing/reproducing section 22 accesses the tone material providing site according to the video time data and title data as the search conditions (step S303).

The tone material providing site receives the video time data and title data as the search conditions from the tone material processing/reproducing section 22, and searches the tone material database 25 according to the search conditions to retrieve tone material data conforming to the search conditions (step S304). The tone material data is retrieved by a known method.

As described above, as in the steps S303 and S304, the tone material processing/reproducing section 22 automatically acquires video characteristic data including the reproduction time of video data, and supplies the same to the tone material providing site. Therefore, the user does not have to recognize the reproduction time of video data, and tone material data to be added to the video data can be acquired from the tone material providing site in an efficient manner, thus improving the working efficiency in video editing. It should be noted that the tone material processing/reproducing section 22 may supply either the reproduction time or the title of video data to the tone material providing site.

Next, the tone material providing site lists the tone material data retrieved in the step S304 and transmits the listed tone material data to the tone material processing/reproducing section 22 (step S305) to carry out the auditing process (step S307).

The tone material processing/reproducing section 22 displays the listed tone material data received from the tone material providing site (step S306) to carry out the auditing process (step S307).

In the auditing process of the step S307, the tone material processing/reproducing section 22 instructs the tone material providing site to stream-distribute (stream) the tone material data, the tone material providing site stream-distributes the tone material data in response to the instruction from the tone material processing/reproducing section 22, the tone material processing/reproducing section 22 stream-reproduces the tone material data distributed from the tone material providing site, and the video editing section 21 reproduces video data in synchronism with the stream-reproduction so that the user can audit the tone material data while reviewing the video data. A detailed description of this auditing process will be given later with reference to FIGS. 4A and 4B. The stream distribution (streaming delivery) means that the tone material providing site distributes data in such a manner as to enable the tone material processing/reproducing section 22 to carry out stream-reproduction without downloading a tone material data file. The stream reproduction (streaming reproduction) means that the tone material processing/reproducing section 22 carries out real-time reproduction of tone material data distributed from the tone material providing site without downloading the same.

When the user has confirmed desired tone material data in the auditing process of the step S307, he or she designates this tone material data by operating the operating element 13. In response to the designation, the tone material processing/reproducing section 22 instructs the tone material providing site to download the designated tone material data (step S308).

In response to the instruction for downloading the tone material data from the tone material processing/reproducing section 22, the tone material providing site distributes the tone material data to the tone material processing/reproducing section 22 (step S309) to terminate the sequence of processing performed by the tone material providing site.

The tone material processing/reproducing section 22 receives the tone material data distributed from the tone material providing site, gives an arbitrary file name to the received tone material data, designates an arbitrary location where the tone material data is desired to be stored, and stores the tone material data (step S310) to carry out a processing/previewing process (step S311).

After the auditing process is carried out in the step S307, the video editing section 21 carries out the processing/previewing process (step S311).

In the processing/previewing process of the step S311, the video editing section 21 reproduces video data in a preview mode, and the tone material processing/reproducing section 22 processes the tone material data stored in the step S310 as the need arises before or during the reproduction of the video data, reproduces the tone material data, which has been processed as the need arises, in synchronism with the reproduction of the video data, and records processing parameters used for processing the tone material data in the tone material data. A detailed description of the processing/previewing process will be given later with reference to FIG. 5.

After the processing/previewing process is carried out in the step S311, the tone material processing/reproducing section 22 carries out a MIDI-to-audio converting process (step S312).

In the MIDI-to-audio converting process, the tone material data (i.e. MIDI data) in which the processing parameters have been recorded by the tone material processing/reproducing section 22 and the software tone generator 22 is converted into data in such an audio format that it can be added to the video data by the video editing section 21. A detailed description of the MIDI-to-audio converting process will be given later with reference to FIG. 6.

The tone material processing/reproducing section 22 stores the converted tone material data in the audio format in an arbitrary file and informs the video editing section 21 to that effect (step S313) to terminate the sequence of processing performed by the tone material processing/reproducing section 22.

The video editing section 21 reads the file stored in the step S313, and adds the read file, i.e. the converted tone material data in the audio format to the video data (step S314) to complete the sequence of processing performed by the video editing section 21.

In the above described main process, the tone material processing/reproducing section 22 directly displays the listed tone material data and gives the instruction for downloading the tone material data, but the present invention is not limited to this. For example, a processing section such as a web browser that executes a display function and an instruction outputting function may be additionally provided to display listed tone material data and give an instruction for downloading the tone material data.

Further, although the tone material processing/reproducing section 22 stores the converted tone material data in the audio format in an arbitrary file (step S313) and the video editing section 21 reads the stored file, the present invention is not limited to this. For example, the tone material processing/reproducing section 22 may convert tone material data into data in an audio format by the MIDI-to-audio converting process (step S312) and then transmit the converted tone material data in the audio format directly to the video editing section 21 without storing the tone material data in a file.

Figure 4A:
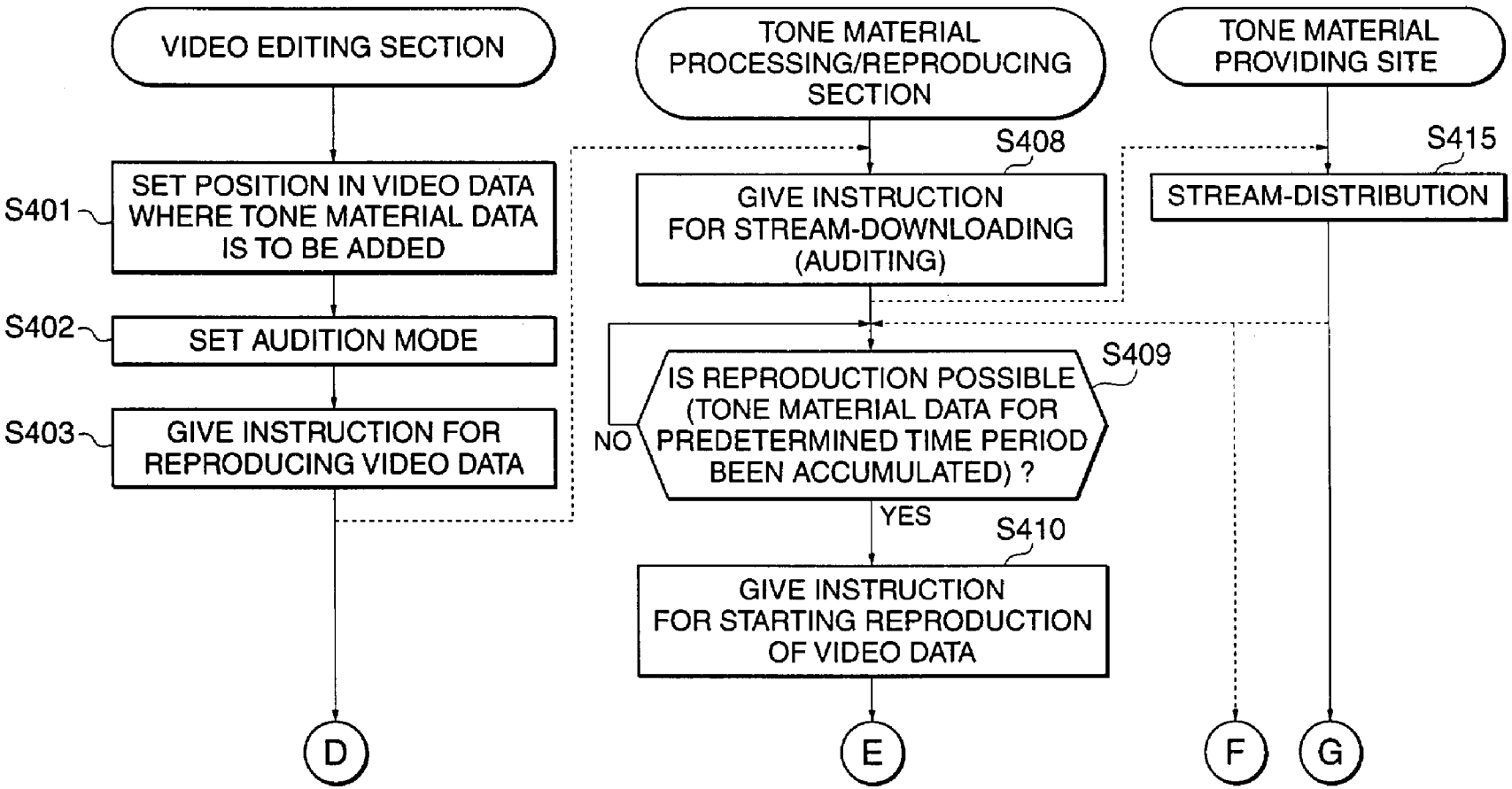
FIGS. 4A and 4B is a flow chart showing an auditing process of a step S307 in FIGS. 3A and 3B.
Figure 4B:
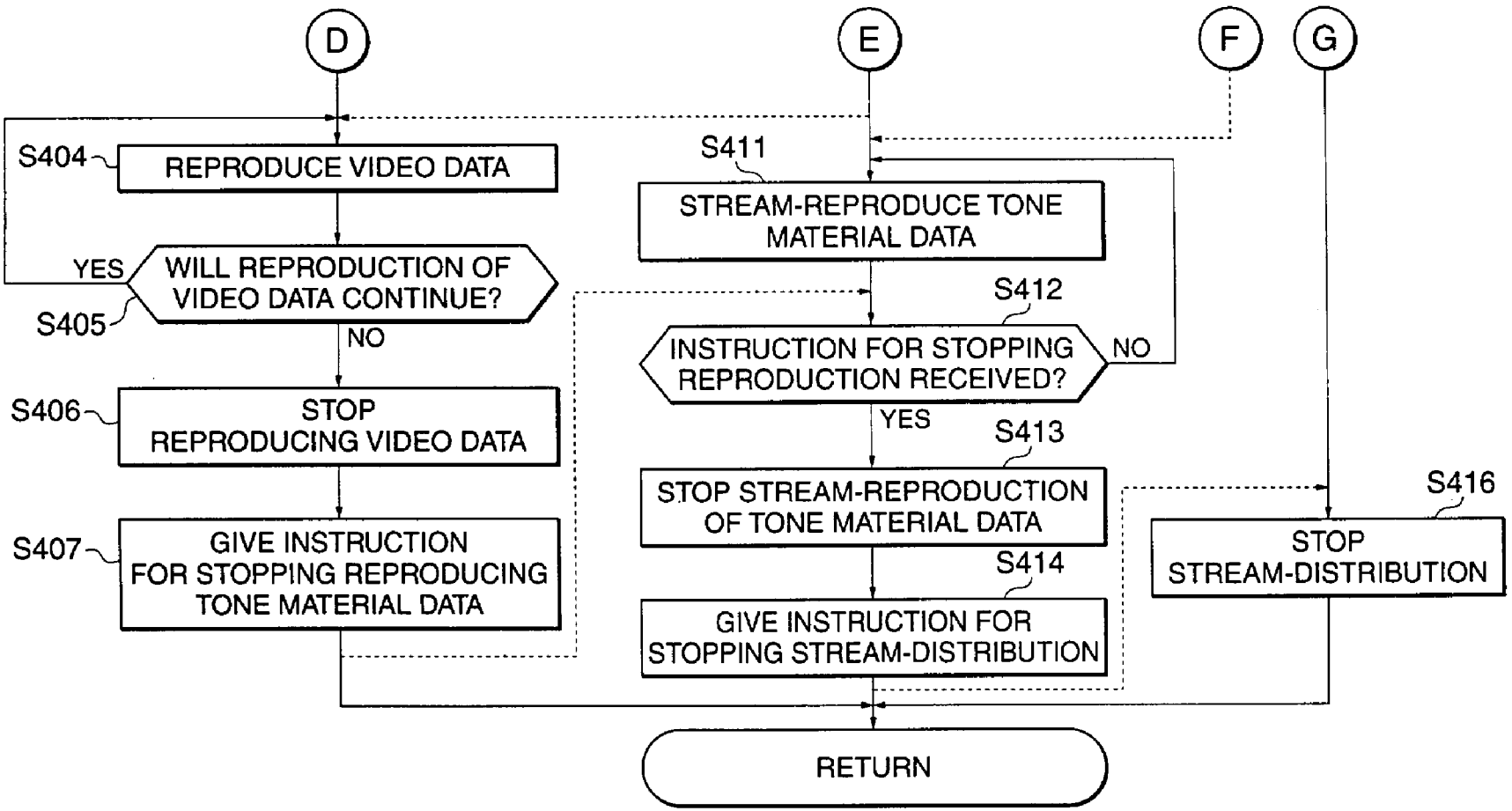

FIGS. 4A and 4B is a flowchart showing the auditing process of the step S307 in FIGS. 3A and 3B.

First, when the user has designated a location within the video data, where the tone material data is to be added, by operating the operating element 13, the video editing section 21 sets the location where the tone material data is to be added (step S401), and sets an audition mode in the video editing program (step S402).

The video editing section 21 then accepts an instruction for reproducing the video data inputted through the operation of the operating element 13 and informs the tone material processing/reproducing section 22 to that effect (step S403). In response, the tone material processing/reproducing section 22 instructs the tone material providing site to stream-distribute tone material data designated in advance through the operation of the operating element 13 among the listed tone material data displayed in the step S306 shown in FIGS. 3A and 3B (step S408).

In response to the instruction for stream-distributing the tone material data from the tone material processing/reproducing section 22 in the step S408, the tone material providing site stream-distributes the tone material data in accordance with the instruction (step S415).

When the tone material providing site carries out the stream distribution, the tone material processing/reproducing section 22 receives the tone material data from the tone material providing site and determines whether stream reproduction is possible or not, that is, whether tone material data for a predetermined period of time has been accumulated or not (step S409). This determination is made to ensure that the stream reproduction is reliably performed. Specifically, the determination is intended to enable the tone material processing/reproducing section 22 to accumulate tone material data to such an extent that tones are reproduced without interruption. The above-mentioned predetermined period of time is, for example, five seconds, and is set by the tone material processing/reproducing section 22 because the stream reproduction is affected by the reproducing process speed of the tone material processing/reproducing section 22 and the communication speed of a network such as the Internet. The accumulation of the tone material data for the predetermined period of time does not mean the accumulation of all of the tone material data, because the stream reproduction is carried out while subsequent data is being received.

If it is determined in the step S409 that the tone material data for the predetermined period of time has been accumulated, the tone material processing/reproducing section 22 instructs the video editing section 21 to start reproducing the video data (step S410), and stream-reproduces the accumulated tone material data for the predetermined period of time and tone material data subsequently distributed from the tone material providing site without interruption (step S411).

On the other hand, in response to the instruction for starting the reproduction from the tone material processing/reproducing section 22, the video editing section 21 reproduces the video data (step S404), and determines whether the reproduction of the video data is to be continued or not according to an instruction for stopping the reproduction of the video data, which is inputted through the operation of the operating element 13, or according to the length of time of the limited video data (step S405).

If it is determined in the step S405 that the video editing section 21 is to continue reproducing the video data, the process returns to the step S404 wherein the video editing section 21 continues reproducing the video data. On the other hand, if it is determined in the step S405 that the video editing section 21 is not to continue reproducing the video data, the reproduction of the video data is stopped (step S406).

The video editing section 21 then instructs the tone material processing/reproducing section 22 to stop reproducing the tone material data based upon the stop of the reproduction of the video data in the step S406 (step S407), to terminate the sequence of processing performed by the video editing section 21, and the process returns to the main process shown in FIGS. 3A and 3B.

After the start of the stream reproduction of the tone material data, the tone material processing/reproducing section 22 determines whether the instruction for stopping the reproduction of the tone material data based upon the stop of the reproduction of the video data, which is transmitted from the video editing section 21 in the step S407, has been received or not (step S412).

If it is determined in the step S412 that the instruction for stopping the reproduction of the tone material data has not yet been received, the process returns to the step S411 wherein the stream reproduction of the tone material data is carried out. On the other hand, if it is determined in the step S412 that the instruction for stopping the reproduction of the tone material data has been received, the stream reproduction of the tone material data is stopped (step S413).

The tone material processing/reproducing section 22 then instructs the tone material providing site to stop the stream distribution of the tone material data (step S414) to terminate the sequence of processing performed by the tone material processing/reproducing section 22, and the process returns to the main process shown in FIGS. 3A and 3B.

After the start of the stream distribution of the tone material data, the tone material providing site stops the stream distribution of the tone material data in response to the instruction for stopping the stream distribution, which is transmitted from the tone material processing/reproducing section 22 (step S416) to complete the sequence of processing performed by the tone material providing site, and the process returns to the main process shown in FIGS. 3A and 3B. Although in the step S412, it is determined whether the tone material processing/reproducing section 22 has received the instruction for stopping the reproduction of the tone material data, which is transmitted from the video editing section 21, the present invention is not limited to this. For example, the tone material processing/reproducing section 22 may access the video editing section 21 to determine whether a stop of the reproduction of the video data has been detected or not, and if it is determined that the stop of the reproduction has not been detected, the process returns to the step S411, and if it is determined that the stop of the reproduction has been detected, the process proceeds to the step S413.

In the above described auditing process, the tone material processing/reproducing section 22 instructs the tone material providing site to stream-distribute tone material data, and in response, the tone material providing site stream-distributes the tone material data, the tone material processing/reproducing section 22 stream-reproduces the tone material data distributed from the tone material providing site, and the video editing section 21 reproduces video data in synchronism with the stream reproduction. Therefore, before downloading tone material data to be added to video data, the user can ascertain how the tone material data (e.g. BGM) will be added to the video data. Therefore, it is possible to improve the working efficiency in video editing (during stream distribution, there is no necessity of designating a file name or a storage place required for downloading, and there is no necessity of erasing a file in the case where the user does not like the file as a result of audition). In particular, the stream reproduction of tone material data does not mean mere stream reproduction of tone material data but means stream reproduction of tone material data in synchronism with the reproduction of video data, and the relation between video data and tone material data to be added to the video data is easy to recognize.

Further, in response to the instruction for reproducing video data, which is transmitted from the video editing section 21, the tone material processing/reproducing section 22 instructs the tone material providing site to stream-distribute predetermined tone material data. At a time point when the stream reproduction of the tone material data stream-distributed from the tone material providing site becomes possible, the tone material processing/reproducing section 22 transmits a permission to start reproducing video data to the video editing section 21 and stream-reproduces the tone material data. Therefore, the tone material data and the video data can be reproduced in synchronism with each other without fail, and there is no possibility that the reproduction of video data is started prior to that of the tone material data.

Further, in response to the instruction for reproducing video data, which is transmitted from the video editing section 21, the tone material processing/reproducing section 22 stops the stream reproduction of tone material data, and then instructs the tone material providing site to stop the stream distribution of the tone material data, or the tone material processing/reproducing section 22 accesses the video editing section 21 to detect a stop of the reproduction of the video data, and instructs the tone material providing site to stop the stream distribution of the tone material data according to the detection result. Therefore, the user does not have to give instructions for stopping respective operations to the video editing section 21, the tone material processing/reproducing section 22, and the tone material providing site.

In the above described auditing process, in response to the instruction for stopping the reproduction of tone material data, which is transmitted from the video editing section 21, the tone material processing/reproducing section 22 stops the stream reproduction of the tone material data, but if the length of time of the tone material data is shorter than a period of time the video editing section 21 reproduces video data, the tone material providing site may automatically stop the stream distribution of the tone material data, without receiving the instruction for stopping the stream distribution from the tone material processing/reproducing section 22, at a time point when the stream distribution of the tone material data is completed. Further, if the file size of data is small like MIDI data, the tone material processing/reproducing section 22 may carry out pseudo stream reproduction in which, after all of the data is received and stored in a cash memory, the reproduction of the data is started and the data is erased from the cash memory at a time point when the reproduction is completed. In this case, there is no necessity of downloading the file, and thus the same effects as described above can be provided.

Figure 5:
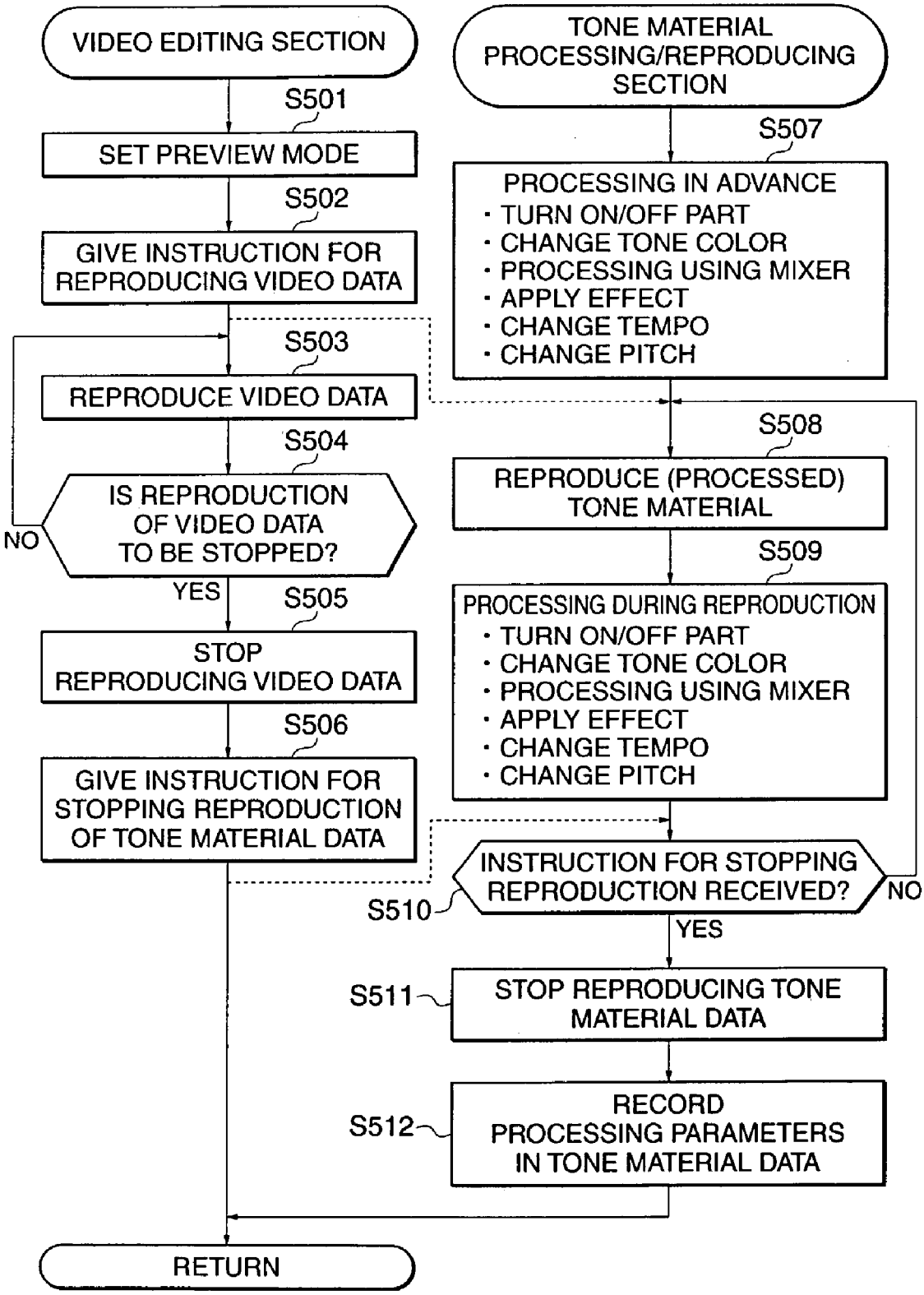
FIG. 5 is a flow chart showing a processing/previewing process of a step S311 in FIGS. 3A and 3B.

FIG. 5 is a flow chart showing the processing/previewing process of the step S311 in FIGS. 3A and 3B.

First, in accordance with an instruction inputted through the operation of the operating element 13 by the user, the video editing section 21 sets a preview mode in execution of the video editing program (step S501).

The video editing section 21 then accepts an instruction for reproducing the video data, which is inputted through the operation of the operating element 13, and transmits information to that effect to the tone material processing/reproducing section 22 (step S502).

The video editing section 21 reproduces the video data (step S503), and determines whether the reproduction of the video data is to be continued or not according to an instruction for stopping the reproduction of the video data, which is inputted through the operation of the operating element 13, or according to the length of time of the limited video data (step S504).

If it is determined in the step S504 that the video editing section 21 is to continue reproducing the video data, the process returns to the step S503 to continue reproducing the video data. On the other hand, if it is determined in the step S504 that the video editing section 21 is not to continue reproducing the video data, the reproduction of the video data is terminated (step S505).

The video editing section 21 then instructs the tone material processing/reproducing section 22 to stop reproducing the tone material data (step S506) to terminate the sequence of processing performed by the video editing section 21, and the process returns to the main process shown in FIGS. 3A and 3B.

On the other hand, the tone material processing/reproducing section 22 performs processing on the tone material data, which is stored in the file in the step S310 shown in FIGS. 3A and 3B, in accordance with an instruction for performing processing on tone material data, which is inputted through the operation of the operating element 13 (step S507). This processing is intended to control parameters of the tone material data such as parameters that enable modification of musical contents of the tone material data in an easy way, e.g. parameters relating to turning-on/off of parts, tone color change, processing using a mixer, application of effects, tempo change, pitch change, and the like. By performing this processing, even a beginner can easily process the tone material data as is different from the case where a MIDI sequencer is used to make sophisticated modifications in which MIDI events are modified one by one, for example. It should be noted that the processing of the step S507 is canceled if no instruction for performing processing is inputted through the operation of the operating element 13.

The tone material processing/reproducing section 22 receives the information to the effect that the video editing section 21 has accepted the instruction for reproducing the video data, which is transmitted from the video editing section 21, and reproduces the tone material data having been processed as the need arises (step S508). Thereafter, as is the case with the step S507, the tone material processing/reproducing section 22 processes the tone material data being reproduced as the need arises (step S509).

The tone material processing/reproducing section 22 then determines whether it has received the instruction for stopping reproducing the tone material data, which instruction is transmitted from the video editing section 21 (step S510). If the tone material processing/reproducing section 22 has not yet received the instruction for stopping the reproduction of the tone material data, the process returns to the step S508 to continue reproducing the tone material data. On the other hand, if the tone material processing/reproducing section 22 has received the instruction for stopping the reproduction of the tone material data, the reproduction of the tone material data is stopped (step S511). Although in the step S510, the tone material processing/reproducing section 22 determines whether it has received the instruction for stopping the reproduction of the tone material data from the video editing section 21 or not, the present invention is not limited to this. For example, the tone material processing/reproducing section 22 may access the video editing section 21 to determine whether a stop of the reproduction of the video data has been detected or not. In this case, if the stop of the reproduction of the video data has not been detected, the process returns to the step S508, and if the stop of the reproduction of the video data has been detected, the process returns to the step S511.

Finally, the tone material processing/reproducing section 22 records the processing parameters, which have been controlled as the need arises in the step S507 or S509, in the tone material data (step S512) to complete the sequence of processing, and the process returns to the main process shown in FIGS. 3A and 3B.

In the processing/previewing process described above, the video editing section 21 reproduces video data in the preview mode, the tone material processing/reproducing section 22 processes tone material data as the need arises before or during the reproduction of the video data, reproduces the tone material data processed as the need arises in synchronism with the reproduction of the video data, and records the processing parameters used for processing the tone material data in the tone material data. Therefore, the user can perform real-time processing on tone material data while reproducing video data, and can ascertain that the processed tone material data and the video data are reproduced in synchronism with each other without waiting for completion of video data with tone material data added thereto. Thus, the user can ascertain how tone material data (e.g. BGM) will be added to video data, and therefore it is possible to improve the working efficiency in video editing. Further, the tone material processing/reproducing section 22 performs processing on tone material data while reproducing the same. Therefore, it is possible to improve the working efficiency in video editing. Further, tone material data which has not yet been processed and tone material data which has been processed may be compared by auditing.

Although in the above described processing/previewing process, if having received the instruction for stopping the reproduction of tone material data, which is transmitted from the video editing section 21, the tone material processing/reproducing section 22 stops reproducing the tone material data, but if the length of time of the tone material data is shorter than a period of time the video editing section reproduces video data, the tone material data processing/reproducing section 22 may automatically stop reproducing the tone material data before receiving the instruction for stopping the reproduction of tone material data, which is transmitted from the video editing section 21.

Figure 6:
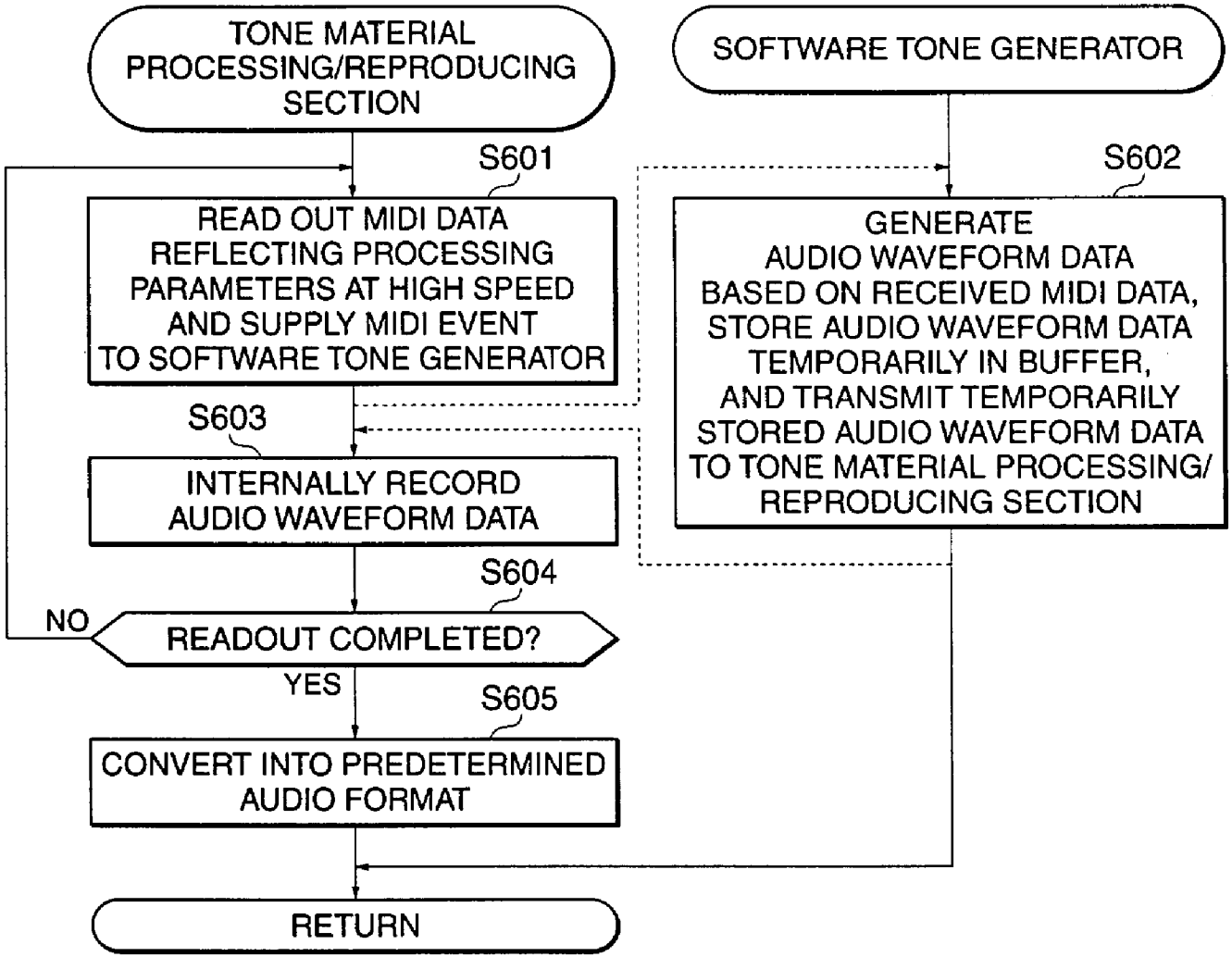
FIG. 6 is a flow chart showing a MIDI-to-audio converting process of a step S312 in FIGS. 3A and 3B.

FIG. 6 is a flow chart showing the MIDI-to-audio converting process of the step S312 shown in FIGS. 3A and 3B.

First, the tone material processing/reproducing section 22 reads the tone material data, in which the processing parameters have been recorded, at a high speed while maintaining the relation in relative time between the MIDI events, and transmits the MIDI data event by event to the software tone generator 23 (step S601).

The software tone generator 23 generates audio waveform data based on the received MIDI data per event, and temporarily stores the generated audio waveform data in a buffer (RAM3). Every time the audio waveform data for a predetermined period of time (e.g. 0.5 second) has been stored, the software tone generator 23 transmits the stored audio waveform data to the tone material processing/reproducing section 22 (step S602). The buffer, which is intended to temporarily store the audio waveform data, stores the audio waveform data generated sequentially in an area that is made free by transmitting the audio waveform data to the tone material processing/reproducing section 22.

The tone material processing/reproducing section 22 sequentially performs internal recording of the audio waveform data for the predetermined period of time, which has been received from the software tone generator 23 (step S603). The internal recording does not mean that the audio waveform data received from the software tone generator 23 is sounded and recorded, but means that the audio waveform data received from the software tone generator 23 is recorded without being sounded.

The tone material processing/reproducing section 22 determines whether all of the MIDI data to be converted has been read or not (step S604). If it is determined in the step S604 that all of the MIDI data to be converted has not yet been read, the process returns to the step S601 to continue reading the MIDI data. On the other hand, if it is determined in the step S604 that all of the MIDI data to be converted has been read, the audio waveform data recorded internally in the step S603 is converted into data in a predetermined audio format that can be handled by the video editing section 21 (step S605) to complete the sequence of processing, and the process returns to the main process shown in FIGS. 3A and 3B.

In the above described MIDI-to-audio converting process, tone material data (i.e. the MIDI data) in which processing parameters have been recorded by the tone material processing/reproducing section 22 and the software tone generator 23 is converted into data in an audio format so that it can be added to the video data by the video editing section 21. Therefore, the sequence of operations from processing on the tone material data up to the conversion of the tone material data into the data in the audio format can be performed all at once, and therefore it is possible to improve the working efficiency. Further, there is no necessity of additionally providing a converter, which converts tone material data into data in an audio format, in addition to the PC 1.

Tone material data provided by the tone material data providing site described above should not necessarily be MIDI data, but it may be data recorded in an audio format. If the tone material data providing site provides data recorded in an audio format, there is no need for carrying out the MIDI-to-audio converting process. In processing of data recorded in an audio format, it is impossible to turn on/off parts, change the tone color, or perform processing using a mixer, but it is possible to apply effects, change the tempo, or change the pitch.

Although the above described audition of tone material data (in the case where tone material data is stream-reproduced or in the case where video data is previewed after processing is performed on tone material data) is carried out in response to the instruction for starting or stopping the reproduction of video data, which is transmitted from the video editing section 21, the audition of tone material data may be carried out in response to an instruction transmitted from the tone material processing/reproducing section 22. Specifically, in the case where tone material data is stream-reproduced, when the tone material processing/reproducing section 22 has given an instruction for stream-reproducing the tone material data, the tone material providing site is instructed to stream-distribute the tone material data, and at a time point when the reproduction of the stream-distributed tone material data becomes possible, the video editing section 21 is instructed to reproduce video data. On the other hand, when the tone material processing/reproducing section 22 has given an instruction for stopping the stream-reproduction, the tone material providing site is instructed to stop the stream-distribution and the video editing section 21 is instructed to stop reproducing video data. Further, in the case where video data is previewed after processing is performed on tone material data, when the tone material processing/reproducing section 22 has given an instruction for previewing the video data, the reproduction of the tone material data is started and the video editing section 21 is instructed to reproduce the video data, and when the tone material processing/reproducing section 22 has given an instruction for stopping previewing the video data, the reproduction of the tone material data is stopped and the video editing section 21 is instructed to stop reproducing the video data.

In the above described processing performed on tone material data, parameters relating to turning-on/off of parts, processing using a mixer, application of effects, tempo change, and/or pitch change are controlled, but it is unnecessary to have all of theses parameters, but it is necessary to have at least one of them. Further, other kinds of processing may also be performed on tone material data. Further, when changing the tempo as one of the parameters, the tempo may be automatically changed so that the video reproduction time and the length of time of tone material data can coincide with each other. The tone material processing/reproducing section 22 and the software tone generator 23 operate in cooperation to realize the MIDI-to-audio converting process, but only the software tone generator 23 may realize the MIDI-to-audio converting process.

Although in the above described embodiment, the functions of the video editing section 21 and the tone material processing/reproducing section 22 are realized by executing different programs by the CPU 2, but may be realized by executing one program by the CPU 2.

Further, the tone material providing site may charge the user for downloading tone material data, and may not charge the user for stream-distributing tone material data.

It is to be understood that the object of the present invention may also be accomplished by supplying a computer or the CPU 2 with a program code of software which realizes the functions of either of the above described embodiments, and causing the computer or the CPU 2 to read and execute the supplied program code.

It is also to be understood that the object of the present invention may also be accomplished by supplying a computer with a storage medium storing a program of software which realizes the functions of the above described embodiments, and causing the computer or the CPU2 to read and execute the program stored in the storage medium.

In this case, the program code itself realizes the novel functions of the present invention, and hence the program code itself read from the storage medium realizes the novel functions of the present invention, and the storage medium on which the program code is stored constitutes the present invention.

Examples of the storage medium for supplying the program code include a floppy disk (registered trademark), hard disk, a flexible disk, an optical disk, a magneto-optical disk, a RAM, a CD-ROM, an MO, a CD-R, a CD-RW, a DVD (a DVD-ROM or DVD-R), a semiconductor memory, a magnetic tape, a nonvolatile memory card, and other ROMS. Further, the program code may be supplied from another electronic musical instrument 12 or from another PC 19 via the network 16.

What is claimed is:

1. A tone material auditing apparatus connected via network to a tone material providing apparatus that provides tone material data, comprising:

a storage section that stores video data;

a video reproducing section that reproduces the stored video data;

a stream-distribution instructing section that instructs the tone material providing apparatus to stream-distribute tone material data to be reproduced in synchronism with reproduction of the video data by said video reproducing section; and a stream-reproducing section that sequentially receives, via the network, the tone material data stream-distributed from the tone material providing apparatus, accumulates the received tone material data, and starts stream-reproducing the accumulated tone material data in synchronism with reproduction of the video data by said video reproducing section when the accumulated tone material data has reached a predetermined amount of data less than the entire amount of the tone material data stream-distributed from the tone material providing apparatus.

2. A tone material auditing apparatus connected via network to a tone material providing apparatus that provides tone material data, comprising:

a video reproducing section that reproduces video data;

a stream-distribution instructing section that instructs the tone material providing apparatus to stream-distribute tone material data to be reproduced in synchronism with reproduction of the video data by said video reproducing section; and a stream-reproducing section that stream-reproduces the tone material data stream-distributed from the tone material providing apparatus in synchronism with reproduction of the video data by said video reproducing section;

wherein said stream-reproducing section comprises a determining section that determines whether it is possible to stream-reproduce the tone material data stream-distributed from the tone material providing apparatus, and a video data reproduction start instructing section responsive to a determination by said determining section that it is possible to stream-reproduce the tone material data, for instructing said video reproducing section to start reproducing the video data;

wherein said stream-reproducing section is responsive to the instruction by said video data reproduction start instructing section, for starting stream-reproducing the tone material data stream-distributed from the tone material providing apparatus.

3. A tone material auditing apparatus according to claim 1, wherein said stream-reproducing section comprises a reproduction stop detecting section that detects a stop of reproduction of the video data by said video reproducing section, and a stream-distribution stop instruction transmitting section responsive to the stop of the reproduction of the video data, for transmitting an instruction for stopping the stream distribution of the tone material data to the tone material providing apparatus.

4. A tone material auditing apparatus connected via a network to a tone material providing apparatus, comprising:

a stream-distribution instructing section that instructs the tone material providing apparatus to stream-distribute the tone material data;

an accumulating section that continuously receives the tone material data stream-distributed, via the network, from the tone material providing apparatus, and accumulates the received tone material data;

a determining section that determines whether the tone material data accumulated in said accumulating section reaches a predetermined amount of data less than the entire amount of the tone material data stream-distributed from the tone material providing apparatus;

a video data reproduction start instructing section that generates a video data reproduction start instruction when it is determined by said determining section that the tone material data accumulated in said accumulating section has reached the predetermined amount of data, wherein the video data reproduction start instruction is used for instructing a video reproducing section to start reproducing video data; and a stream-reproducing section responsive to the generated video data reproduction start instruction, for starting stream-reproducing the accumulated tone material data.

5. A tone material auditing apparatus connected via a network to a tone material providing apparatus, comprising:

a stream-reproducing section that sequentially receives, via the network, the tone material data stream-distributed from the tone material providing apparatus, accumulates the received tone material data, and starts stream-producing the accumulated tone material data when the accumulated tone material data has reached a predetermined amount of data less than the entire amount of the tone material data stream-distributed from the tone material providing apparatus;

a reproduction stop detecting section that detects a stop of reproduction of video data in a video reproducing device; and a stream-distribution stop instruction transmitting section responsive to the detected stop of reproduction of the video data, for transmitting an instruction for stopping stream-distributing the tone material data to the tone material providing apparatus.

6. A tone material editing apparatus comprising:

a video data storing section that stores video data;

a tone material data storing section that stores tone material data to be associated with the video data, wherein the tone material data is MIDI standard compatible and includes a series of event data;

a video reproducing section that reproduces the stored video data;

a tone material modifying and reproducing section that starts reproducing the tone material data when said video reproducing section starts reproducing the video data, modifies, according to a user instruction when said video reproducing section is reproducing the video data and when said tone material modifying and reproducing section is reproducing the tone material data, parameters included in the tone material data that is being reproduced, and records the modified parameters into the tone material data;

a converting section that converts in real time the tone material data, in which the modified parameters have been recorded, into audio waveform data in a predetermined audio format;

an audio data storing section that stores the converted audio waveform data; and an associating section that associates the stored audio waveform data with the video data.

7. A tone material editing apparatus according to claim 6, wherein the parameters included in the tone material data comprise parameters for controlling at least one of turning-on/off of parts, tone color change, modifying using a mixer, application of effects, tempo change, and pitch change.

8. A tone material editing apparatus according to claim 6, wherein said tone material modifying and reproducing section operates in cooperation with the video data reproducing section.

9. A tone material acquiring apparatus connected via a network to a tone material providing apparatus that provides plural pieces of tone material data, comprising:

a characteristic data acquiring section that is connected to a video editing device capable of editing video data and that acquires, from video editing device, characteristic data representing at least one of a reproduction time of the video data and a title of the video data;

a characteristic data transmitting section that transmits, as a search condition, via the network the characteristic data acquired by said characteristic data acquiring section to the tone material providing apparatus; and a tone material data receiving section that receives a predetermined piece of tone material data to be associated with the video data, which is selected from among the plural pieces of tone material data by the tone material providing apparatus according to the characteristic data transmitted thereto, from the tone material providing apparatus via the network.

10. A tone material auditing program executed by a computer connected via network to a tone material providing apparatus that provides tone material data, comprising:

a video reproducing module for reproducing video data;

a stream-distribution instructing module for instructing the tone material providing apparatus to stream-distribute tone material data to be reproduced in synchronism with reproduction of the video data reproduced by said video reproducing module; and a stream-reproducing module that sequentially receives, via the network, the tone material data stream-distributed from the tone material providing apparatus, accumulates the received tone material data, and starts stream-reproducing the accumulated tome material data in synchronism with reproduction of the video data by said video reproducing module section when the accumulated tone material data has reached a predetermined amount of data less than the entire amount of tone material data stream-distributed from the tone material providing apparatus.

11. A tone material auditing program executed by a computer connected via a network to a tone material providing apparatus that provides tone material data, comprising:

a stream-distribution instructing module for instructing the tone material providing apparatus to stream-distribute the tone material data;

an accumulating module that continuously receives the tone material data stream-distributed, via the network, from the tone material providing apparatus, and accumulates the received tone material data;

a determining module for determining whether the tone material data accumulated in said accumulating module reaches a predetermined amount of data less than the entire amount of the tone material data stream-distributed from the tone material providing apparatus;

a video data reproduction start instructing module that generates a video data reproduction start instruction when it is determined by said determining module that the tone material data accumulated in said accumulating module has reached the predetermined amount of data, wherein the video data reproduction start instructing is used for instructing a video reproducing module to start reproducing video data; and a stream-reproducing module responsive to the generated video data reproduction start instruction, for starting stream-reproducing the accumulated tone material data.

12. A tone material auditing program executed by a computer connected via a network to a tone material providing apparatus that provides tone material data, comprising:

a stream-reproducing module for sequentially receiving, via the network, the tone material data stream-distributed from the tone material providing apparatus, accumulates the received tone material data, and starts stream-reproducing the accumulated tone material data when the accumulated tone material data has reached a predetermined amount of data less than the entire amount of the tone material data stream-distributed from the tone material providing apparatus;

a reproduction stop detecting module for detecting a stop of reproduction of video data in a video reproducing module; and a stream-distribution stop instruction transmitting module responsive to the detected stop of reproduction of the video data, for transmitting an instruction for stopping stream-distributing the tone material data to the tone material providing apparatus.

13. A tone material editing program executed by a computer storing tone material data, comprising:

a video data storing module for storing video data;

a tone material data storing module for storing tone material data to be associated with the video data, wherein the tone material data is MIDI standard compatible and includes a series of event data;

a video reproducing module that reproduces the video data;

a tone material modifying and reproducing module that starts reproducing the tone material data when said video reproducing module starts reproducing the stored video data, modifies, according to a user instruction when said video reproducing module is reproducing the video data and when said tone material modifying and reproducing module is reproducing the tone material data, parameters included in the tone material data that is being reproduced, and records the modified parameters into the tone material data;

a converting module for converting in real time the tone material data, in which the modified parameters have been recorded, into audio waveform data in a predetermined audio format;

an audio data storing module that stores the converted audio waveform data; and an associating module that associates the stored audio waveform data with the video data.

14. A tone material acquiring program connected via a network to a tone material providing apparatus that provides plural pieces of tone material data, comprising:

a characteristic data acquiring module that facilitates communication with a video editing device capable of editing video data and that acquires from the video editing device, characteristic data representing at least one of a reproduction time of the video data and a title of the video data;

a characteristic data transmitting module for transmitting, as a search condition, via the network the characteristic data acquired by said characteristic data acquiring module to the tone material providing apparatus; and a tone material data receiving module for receiving a predetermined piece of tone material data to be associated with the video data, which is, selected from among the plural pieces of tone material data by the tone material providing apparatus according to the characteristic data transmitted to the tone material providing apparatus, from the tone material providing apparatus via the network.

* * * * *